United States Patent [19]

Haude

[11] 4,076,178

[45] Feb. 28, 1978

[54] DEVICE FOR CONTROLLING FLOW FROM THE DISCHARGE END OF A TUBULAR BALL MILL OR THE LIKE

[75] Inventor: Friedhelm Haude, Cologne, Germany

[73] Assignee: KHD Industrienlagen AG

[21] Appl. No.: 692,220

[22] Filed: Jun. 2, 1976

[30] Foreign Application Priority Data

Jun. 6, 1975 Germany ..... 2525242

[51] Int. Cl.[2] ..... B02C 17/18

[52] U.S. Cl. ..... 241/33; 241/34

[58] Field of Search ..... 241/33, 34, 63, 64; 137/577

[56] References Cited

U.S. PATENT DOCUMENTS

| | | | |
|---|---|---|---|
| 1,321,513 | 11/1919 | Eaton | 137/577 |
| 1,694,471 | 12/1928 | Jacobs | 137/577 |
| 1,990,178 | 2/1935 | Frisch | 241/34 |
| 2,109,449 | 3/1938 | Harman | 241/33 |
| 2,291,618 | 8/1942 | Frisch | 241/33 |

*Primary Examiner*—Granville Y. Custer, Jr.
*Attorney, Agent, or Firm*—Hill, Gross, Simpson, Van Santen, Steadman, Chiara & Simpson

[57] ABSTRACT

A generally vertically adjustable device is located within the discharge end of a housing such as a tubular ball mill for controlling flow into an outlet. Control of a level of accumulation in the housing, or evacuation of material from the housing can be selectively effected. Operation of the device is controlled from outside of the housing, and may comprise automatic condition responsive means or manually operable means.

14 Claims, 4 Drawing Figures

DEVICE FOR CONTROLLING FLOW FROM THE DISCHARGE END OF A TUBULAR BALL MILL OR THE LIKE

This invention relates to a new and improved device for controlling flow from the discharge end of a tubular ball mill or the like, and is more particularly concerned with such a device which is readily operated from outside of a housing from which flow of fluent material to an outlet must be controlled.

By way of example of the prior art, German Pat. No. 1,210,307 is referred to, according to which a continuously operating tubular ball mill has an overflow control arrangement in the discharge area of the mill. According to that patent the overflow control consists of two cylindrical hollow members arranged in superimposed projecting relation into the grinding drum in offset relation with respect to one another about a common axis. These cylindrically shaped hollow bodies have laterally openings slot-type openings in the walls opposite one another and manually adjustable as to width of the slot openings. By altering the widths of the slot-like openings, level of accumulation of the comminuted material may be attained according to anticipated particular grinding conditions. However, in order of effect adjustments in the slot openings, the ball mill must be shut down.

It is therefore an important object of the present invention to provide a new and improved device for controlling flow from the discharge end of a tubular ball mill or the like and which is adapted for regulation or adjustment from outside of the chamber within which flow control must be accomplished, and in addition such regulation or adjustment may be effected during operation of the apparatus.

To the accomplishment of this object, the device comprises means in the form of control valves for maintaining a desired fluent material level in the flow control chamber or for evacuating the chamber as desired or necessary. Control or adjustment of the valve means is adapted to be effected by means extending through the chamber wall, such as a generally vertically extending adjusting or control member so that even during operation of the apparatus with which associated, the device can be adjusted or regulated from outside of the chamber. Where, by way of example, the valve means are located at opposite ends of a hollow body an upper valve member having fixed flow area flow passage means therethrough is adjustable vertically to control the level of accumulation of fluent material in the chamber, and a valve member at the lower end of the tubular member having comparable flow passage will remain in restrictive relation to the discharge outlet while the upper valve member is functioning, but when it is desired to flush or evacuate the chamber, the lower valve member is adapted to be opened for relatively free flow of material out of the chamber.

Where the device is used in association with a tubular ball mill, an important attribute of the invention resides in that where a gaseous media is introduced into the mill in the course of the grinding process and particularly in the case of deep-cooling grinding, the gaseous media may be held substantially constant as to volume. Accordingly in comparison with prior grinding processes where a gaseous media is introduced, substantial savings can be effected by use of the device of the present invention.

The new and improved device of the present invention is adapted to be regulated or adjusted either automatically, or manually.

Other objects, features and advantages of the invention will be readily apparent from the following description of a representative embodiment thereof, taken in conjunction with the accompanying drawings although variations and modifications may be effected without departing from the spirit and scope of the novel concepts embodied in the disclosure and in which.

Figure 1:
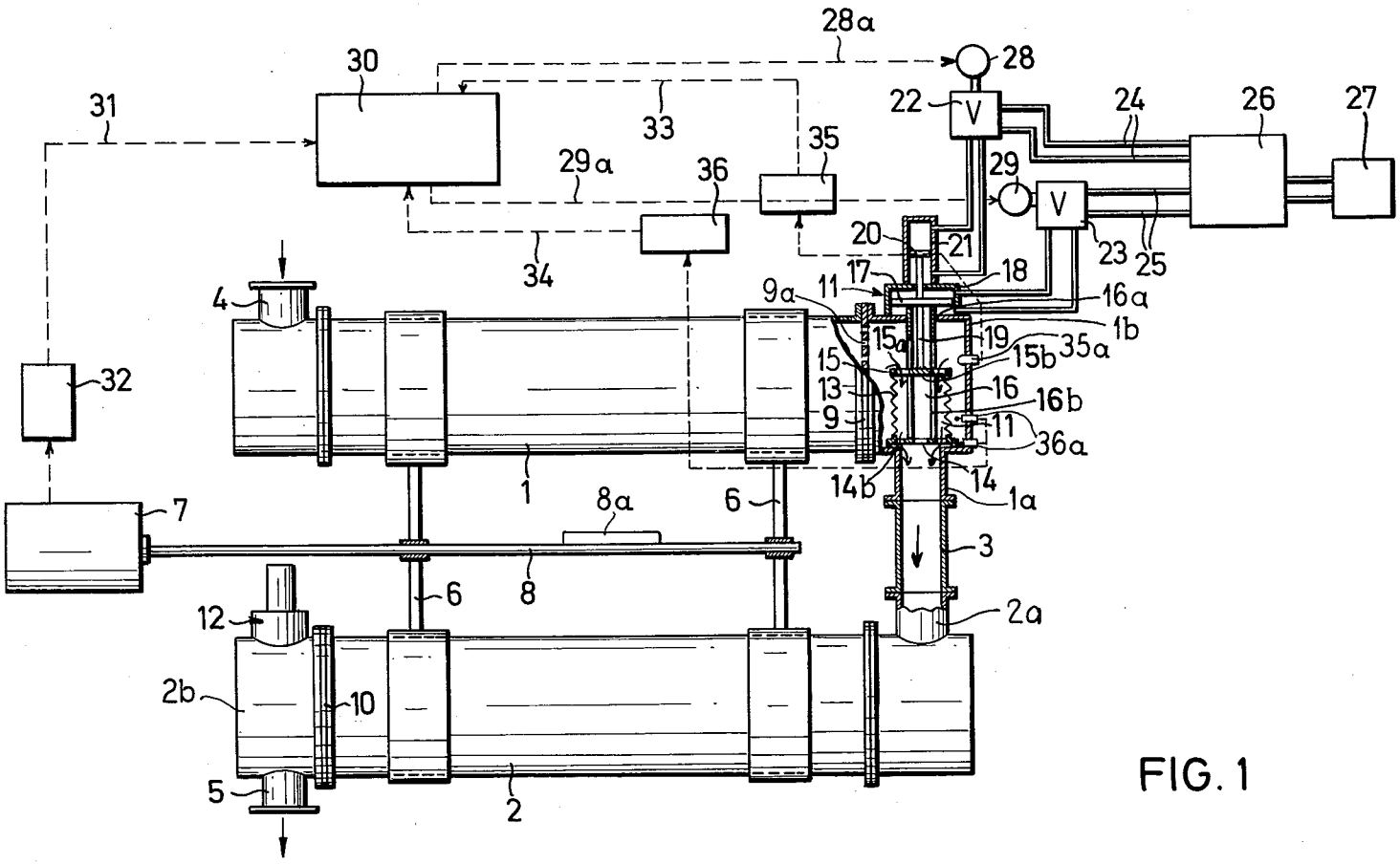
FIG. 1 is a schematic illustration of tubular ball mill apparatus embodying two grinding drums in a series and partially in section illustrating a system for automatically adjusting the flow controlling device of the present invention.

By way of example of an important use for the present invention, tubular ball mill apparatus is illustrated in FIG. 1 comprising at least a hollow drum, tubular ball mill 1 but in this instance also a second tubular ball mill 2 in series with the mill 1. It should be understood that the invention is useful for controlling level of accumulation of fluent material whether solid, liquid or gaseous, or combinations thereof. Further, the device of the present invention may be used with apparatus operating continuously or intermittently.

Having reference to the tubular ball mill apparatus of FIG. 1, they are connected in series with one another through a pipe 3 which is coupled to a discharge outlet **1*a* leading from a closed chamber 1*b* on the discharge end of the tubular ball mill 1. At its delivery end, the pipe 23 is coupled to an inlet 2*a* into the charging end of the tubular ball mill 2. Material to be comminuted is charged into the tubular ball mill 1 through a charging inlet 4 at the opposite end of the mill from the chamber 1*b*. After material charged into the mill 1 has been comminuted therein, it passes successively through the mill 2 in which it is further comminuted and is then discharged from the mill 2 by way of a flow control chamber 2*b* from which leads a discharge outlet 5. A frame 6 supports the mills 1 and 2 which are adapted to be oscillatably operated for grinding by means of an electrical motor 7 driving a shaft 8 provided with imbalance mass means 8*a*. Between the discharge end of the tubular drum housing of the mill 1 and the flow controlling chamber 1*b* is disposed a screen wall 9 (FIGS. 1, 2 and 3), and between the discharge end of the drum of the mill 2 and the chamber 2*b* is located a similar screen wall or partition 10. For controlling flow from the chamber 1*b*, there is provided a device 11, and for controlling flow from the chamber 2*b* there is provided a device 12 which may be substantially the same as the device 11, and in view of such similarity a detailed description will be given with respect to the device 11 which will be understood to be equally applicable to the device 12 which is illustrated only schematically without duplication of the various elements which will be described in detail in connection with the device 11**.

In a preferred construction, each of the devices 11 and 12 comprises a hollow tubular body 13 which is located substantially vertically in the associated flow control chamber such as the chamber 1b and is vertically adjustable. In a preferred form, the hollow body 13 comprises a cylindrical bellows. At its lower end the hollow body 13 is attached in sealed relation to a valve disk 14 of larger diameter than and disposed in controlling relation to the mouth of the discharge outlet 1a. At its upper end, the tubular body 13 is sealingly attached to a valve disk 15. Attached concentrically to the upper side of the valve disk 14 is an elongate upwardly extending tubular adjusting member 16 which passes in reciprocably slidable relation through a bearing port 16a in the top of the wall of the chamber 1b. On its upper end out side of the chamber 1b the adjusting tube member 16 has fixedly thereon a piston 17 which is reciprocable in a double acting cylinger 18. The valve disk 14 has radially adjacent to the attached adjusting member 16, and inside the tubular body 13 at least one and preferably a plurality of circumferentially spaced discharge ports 14b. Similarly, the upper disk valve 15 has at least one and preferably a plurality of inlet ports 15a which are desirably of matching cross-sectional flow area relative to the discharge ports 14b and located radially adjacent the outside of the tubular adjustment member 16 and arranged to discharge into the body 13 for flow of material through the body and then through the discharge ports 14b into the discharge outlet 1a.

Figure 4:
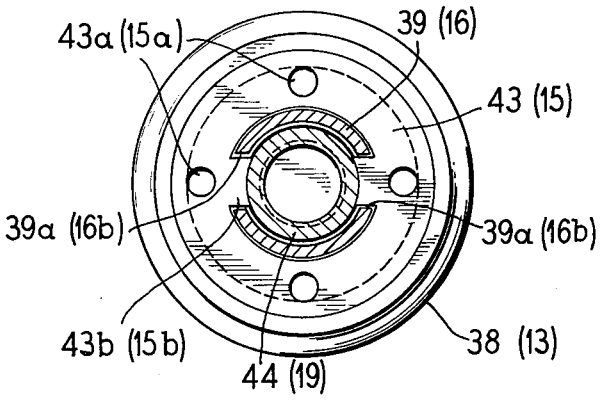
FIG. 4 is an enlarged fragmentary horizontal sectional detail view taken substantially along the line IV—IV of FIG. 2.

In order to enable vertical adjustment movements of the disk 15, the disk 15 is constructed as an annulus which is vertically slidably guided relative to the tubular adjustment member 16 as best visualized in FIG. 4. Vertical relative adjustments of the disk 15 are adapted to be effected by means of an elongate member comprising a vertical adjustment rod 19 concentrically within the tubular adjustment member 16 and attached at its lower end to a spider 15b on the disk 15 extending through vertical clearance slots 16b in the tubular member 16 as best visualized in FIG. 4. The rod 19 extends in slidable bearing relation through the center of the piston 17. On its upper end the rod 19 has a piston 20 which is reciprocable in a double acting cylinder 21. For controlling the cylinder units 17, 18 and 20, 21 suitable hydraulic or pneumatic pressure fluid systems are provided, the piston cylinder unit 20, 21 being controlled by a suitable valve 22 and the piston cylinder 17, 18 being controlled by a suitable valve 23. The valve 22 controls the direction of the operating pressure fluid through conduits 24 and the control valve 23 controls the pressure fluid through pressure conduits 25. A pump 26 is connected in suitable manner to the pressure conduits 24 and 25 and is desirably provided with a pressure equalizing chamber 27. A suitable electro-mechanical sensing and regulating system for controlling the valves 22 and 23 comprises valve actuating means 28 for the valve 22 and valve actuating means 29 for the valve 23. A lead 28a connects the control means 28 with a regulator 30 and a lead 29a connects the valve operating means 29 with the regulator 30. Through a lead 31, the regulator 30 is coupled with the motor 7 through a current transformer 32.

In operation of the tubular ball mill apparatus, and having reference to the mill 1 by way of example, the comminuted material issuing through screen openings 9a in the separating screen 9 is adapted to accumulate within the chamber 1b and the level of accumulation is controlled for optimum functioning of the mill by the proper setting, regulation or control of the device 11, and more particularly by adjusting the position of the valve disk 15 for optimum accumulation level as permitted by the bellows body 13. For automatic vertical adjustment of the valve disk 15 in accordance with variations in level of accumulation in the chamber 1b, suitable level detecting means 35a are located on the chamber 1a to signal by way of the selsyn 35 to the regulator 30 deviations from an optimum accumulation level in the chamber established by setting of the regulator 30 to a theoretical value in accordance with results desired in respect to the material being processed. Through the regulator 30 to valve actuator 28 appropriately operates the valve 22 to operate the piston cylinder motor 20, 21 to shift the valve disk 15 up or down until the accumulation level is adjusted to at least approximately the optimum level. As to the piston and cylinder motor 17, 18, limit switch means 36a are located for sensing position of the disk valve 14b and through the sensing signal transmittor 36 and the lead 34 directing information to the regulator 30. Upon differences occurring between the actual and theoretical value which cannot be corrected by further movement of the disk 15, as controlled by operation of the actuator 28 and the control valve 22, the piston 20 will be operated upwardly or downwardly and thereby the accumulation level of the treated material in the chamber 1b will be altered until normal operation is again attained. Where the piston 17 is shifted to its lowermost limit and the accumulation level in the chamber 1b reaches an uppermost limit so that no further equalization is attained by further movement of the disk 15, the regulator impulses through the electrical lead 29a to the valve actuator 29 operate the valve 23 for shifting the piston 17 to its upper position whereby the lower disk valve 14 is raised to open the mouth of the discharge outlet 1a to dump all of the treated material from the chamber 1b, as for example when it is desired to evacuate all material from the mill.

In case the load on the motor 7 becomes excessive as reflected through the current transformer 32, signals are conveyed through the line 31 to the regulator 30 which inturn signals the valve actuator 28 to operate the valve 22 for lowering the piston valve 15 and thereby effecting a corresponding lowering in the accumulation level of the treated material in the chamber 1b which will tend to alleviate load on the motor. However should the load on the motor 7 not be sufficiently reduced, then the regulator 30 will send a signal to operate the actuator 29 and thereby operate the valve 23 for effecting raising of the lower disk valve 14 to effect direct release of treated material to the discharge outlet 1a, thereby bypassing the disk valve 15, thus quickly lowering the accumulation level of treated material in the chamber 1b until the load on the mill and the driving motor is relieved.

It will thus be apparent that the tubular ball mills may be advantageously driven under optimum grinding conditions and under maximum load because the level adjusting device 11, or 12, as the case may be, with the sensing and regulating system of FIG. 1 efficiently monitors and controls the accumulation level of the treated material in the discharge area of the respective tubular ball mill, and every deviation from a predetermined setting or volume will be corrected by corresponding adjustment of the accumulation level in the accumulator chamber.

Figure 2:
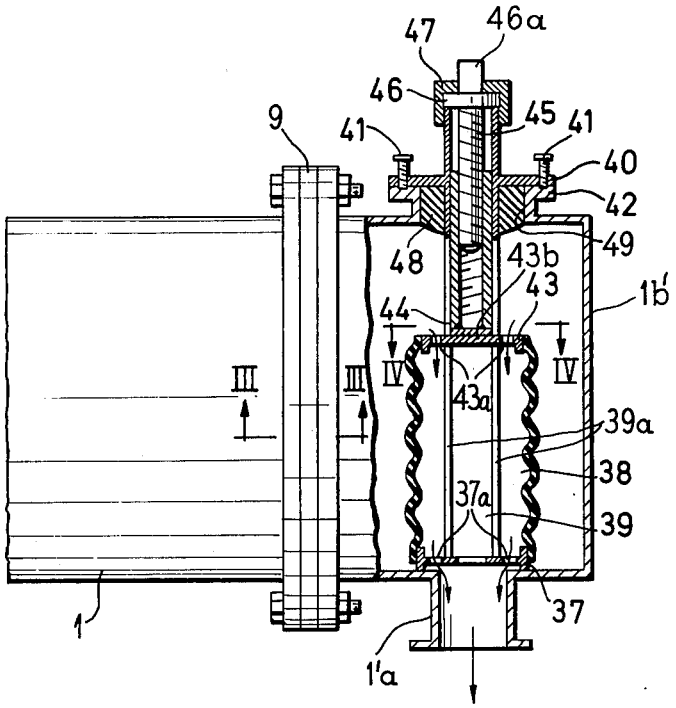
FIG. 2 is a fragmentary side elevational view, partially in section, showing a manually adjustable form of the device according to the present invention.
Figure 3:
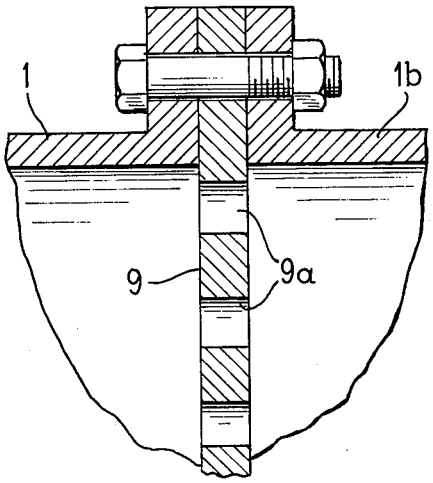
FIG. 3 is an enlarged fragmentary sectional detail view taken substantially along the line III—III of FIG. 2.

Refererring now to FIG. 2 a simple manually adjustable form of the device is depicted wherein controlling manipulation can be effected externally of the apparatus even while the apparatus is in operation. Similarly as in FIG. 1, the tubular ball mill apparatus in FIG. 2 includes the ball mill 1 at the discharge end of which comminuted material passes through the screen partition 9 into an accumulator and flow control chamber 1b' to discharge through a lower discharge outlet 1a'. Normally direct discharge of treated material from the chamber 1b' through the discharge outlet 1a' is restrained by a disk valve 37 sealingly attached to the lower end of an expansible and contractable tubular hollow body 38 desirably in the form of a bellows. Secured concentrically to the disk valve 37 is an elongate upwardly extending tubular valve actuator 39 which projects upwardly from the top of the chamber 1b' and has on the upwardly projecting portion a fixed flange 40 carrying adjustment screws 41 bearing against a flange 42. The flange 40 also serves to retain packing 48 of rubber or synthetic material about the tubular adjustment member 39 where it projects through an opening 49 in the top wall of the chamber 1b' and about which the flange 42 is located. Sealingly secured to and carried by the upper end of the longitudially adjustable body 38 is an upper disk valve 43 having one or more inlet metering ports 43a for passage of treated material from the chamber 1b to pass downwardly and escape through corresponding one or more discharge ports 37a through the lower valve disk 37 to the discharge outlet 1a'. A spider 43b of the valve 43 and of the same order of the spider 15b in FIG. 4, extends through vertical clearance slots 39a in the tubular actuator 39. Secured centrally fixedly to the spider 43b is a vertical elongate hollow adjustment rod 44 extending telescopically upwardly within the tubular actuatory 39. At least in its upper portion the rod 44 is internally threaded and engaged by an adjusting screw 45 having a collar flange 46 engaged upon the upper end of the member 44 and retained for relative rotation by a cap nut 47 through which extends upwardly a wrench engageable stem 46a by which the adjustment screw rod 45 can be turned.

From the foregoing it will be observed the the position of the valve disks 37 and 43 in the chamber 1b' can be advantageously adjusted vertically within the chamber 1b' from outside of the chamber so that the desired level of accumulation of treated material in the chamber 1b' can be readily attained. By adjusting the set screws 41, the vertical position of the lower valve disk 37 can be readily adjusted relative to the mouth of the discharge outlet 1a'. Lifting or lowering of the valve disk 43 is readily effected by manipulation of the screw 45. Thus, by adjustment of the valve disk 43 by means of the screw 45, a predetermined accumulation level of the treated material can be maintained for any particular operation. When it is desired to evacuate the accumulation chamber 1b' and the mill 1, lifting of the lower valve disk 37 to bypass all of the material into the discharge outlet 1a' will effect this result.

It will be understood that variations and modifications may be effected without departing from the spirit and scope of the novel concepts of this invention.

I claim as my invention:

1. A device for controlling flow from the discharge end of associated apparatus such as a tubular ball mill or the like, wherein treated fluent material is received in an accumulation chamber having a lower discharge outlet, the device comprising:

a vertically contractible and expandable hollow body having a metering valve disk on its upper end and a discharge outlet controlling valve disk on its lower end, said valve disks having material metering ports communicating through said hollow body;

means for adjusting the level of the upper valve disk to control the accumulation level of material while the lower of the disks closes the discharge outlet except for the metered flow through said metering ports;

and means for independently raising said lower valve disk to open the discharge outlet for bypassing of the treated material into the discharge outlet.

2. A device according to claim 1, wherein the apparatus operates at optimum efficiency at a predeteremined accumulation level of the material in the accumulation chamber, said device including a system for effecting automatic operation of said adjusting means responsive to deviations from said predetermined accumulation level, to restore the predetermined level.

3. A device according to claim 2, wherein said system includes means for sensing said deviation from the predetermined accumulation level of material in the accumulation chamber.

4. A device according to claim 2, including sensing means generating a control signal indicating the position of said lower valve disk.

5. A device according to claim 2, wherein said apparatus comprises a tubular ball mill, a motor for driving said mill operatively, and motor load sensitive means for controlling said system whereby the lower valve disk is lifted responsive to motor overload.

6. A device according to claim 2, wherein said means for adjusting the level and said means for raising and lowering comprise pressure fluid operated motors, and said control system comprises electro-mechanical means for controlling said motors.

7. A device according to claim 1, wherein said adjusting means and said raising means are accessible outside of said chamber and are adapted for manual operation.

8. A device according to claim 1, wherein said tubular body comprises a bellows structure, said upper valve disk being secured in sealed relation to the upper end of the bellows structure and said lower valve disk being secured in sealed relation to the lower end of said bellows structure.

9. A device according to claim 1, wherein said means for raising and lowering the lower disk comprises an elongate member secured at its lower end to said lower disk and projecting upwardly through said upper disk and through an upper wall area of the chamber, and said means for adjusting the level of said upper disk comprises an elongate member fixed to said upper disk and projecting upwardly through said upper wall area.

10. A device adapted for controlling discharge of fluent material in apparatus, such as comminuted material from a tubular ball mill, and including a discharge outlet, the device comprising:

a generally upright hollow body having a passage therethrough for communication with said discharge outlet;

closures on the opposite ends of the hollow body;

said closures each having at least one passage opening therethrough for material to flow through the passage opening of the upper closure and through the passage and then through the lower closure passage opening;

and means connected to said closures for vertically adjusting at least one closure relative to the discharge outlet.

11. A device according to claim 10, wherein said closures comprise valve disks fixed on the opposite ends of the hollow body.

12. A device adapted for controlling discharge of fluent material in apparatus, such as comminuted material from a tubular ball mill, and including a discharge outlet, the device comprising:

a generally upright hollow body adapted to be lengthened and shortened and having a passage therethrough for communciation with said discharge outlet;

a perforated metering disk on the upper end of said body; a perforated metering disk on the lower end of said body; means for vertically adjusting the lower disk relative to said discharge outlet comprising an elongate adjusting member secured at a lower end to the lower of said disks and an upper end projecting outside of an enclosure defining a material accumulation chamber;

said upper end having a flange; set screws carried by the flange; an abutment surface on the outside of said enclosure against which set screws thrust for effecting vertical adjustments of said member and thereby said lower disk;

an elongate adjusting member fixed on said upper disk and comprising a rod guided through a central bore of said lower disk adjusting member;

and screw means for effecting vertical adjustments of said rod and thereby of said upper disk.

13. A device adapted for controlling discharge of fluent material in apparatus, such as comminuted material from a tubular ball mill, and including a discharge outlet, the device comprising:

a generally upright hollow body having a passage therethrough for communication with said discharge outlet;

means on the upper end of said body comprising at least one metering post for flow of material to said body passage;

means for vertically adjusting said body relative to the discharge outlet comprising a tubular member attached to the lower end of said body and projecting upwardly through the upper end of said body to the outside of a housing within which said body is located;

a rod member fixed to the upper end of said body and extending up through said tubular member;

double acting piston-cylinder pressure fluid operated motors located outside of said housing and operatively connected with said tubular member and said rod;

and a sensing and regulating system connected with said motors for automatically actuating said motors.

14. A device adapted for controlling discharge of fluent material in apparatus, such as comminuted material from a tubular ball mill, and including a discharge outlet, the device comprising:

a generally upright hollow body having a passage therethrough for communication with said discharge outlet;

means on the upper end of said body comprising at least one metering port for flow of material to said body passage;

means for vertically adjusting said upper end of the body relative to the discharge outlet comprising pressure fluid actuated motor means;

regulator means responsive to the level of material adjacent said body;

and means controlled by the regulator means for operating said motor means.

* * * * *